United States Patent [19]

Wilhelmy

[11] 4,248,449

[45] Feb. 3, 1981

[54] CANTILEVER TWO PIECE SKI

[76] Inventor: Whitney Wilhelmy, 6510 Idlewood Rd., Tahoe Vista, Calif. 95732

[21] Appl. No.: 728,297

[22] Filed: Sep. 30, 1976

[51] Int. Cl.[3] ..... A63C 5/07

[52] U.S. Cl. ..... 280/603

[58] Field of Search ..... 280/603; 9/310 C; 124/79

[56] References Cited

U.S. PATENT DOCUMENTS

| | | | |
|---|---|---|---|
| 2,545,209 | 3/1951 | Meehan | 280/603 |
| 3,104,888 | 9/1963 | Day et al. | 280/603 |
| 3,825,360 | 7/1974 | Gallich | 280/603 X |

FOREIGN PATENT DOCUMENTS

| | | | |
|---|---|---|---|
| 128907 | 2/1932 | Austria | 280/603 |

*Primary Examiner*—Robert B. Reeves
*Assistant Examiner*—Gene A. Church
*Attorney, Agent, or Firm*—Herbert C. Schulze

[57] ABSTRACT

This invention is a collapsible ski, wherein the ski is broken down into two parts, and wherein the two parts are so joined together as to maintain the appropriate strength and flex characteristics of the ski, particularly with appropriate reference to the proportioning of the ski so as not to destroy its characteristics and to maintain the appropriate proportions for maximum ski performance. A special, quick disconnect means is used to hold the ski parts together when desired or to break them down when desired.

4 Claims, 9 Drawing Figures

CANTILEVER TWO PIECE SKI

CROSS REFERENCE TO RELATED PATENT APPLICATIONS

This application is not related to any other co-pending patent applications filed by me, although reference is made to a ski pole, usable in conjunction with this ski, of the nature of my ski pole recited in presently co-pending patent application Ser. No. 592,127 filed June 30, 1975 now abandoned.

BACKGROUND OF THE INVENTION

1. FIELD OF THE INVENTION

This invention is in the general field of skis and more particularly is directed to a new and unique collapsible ski, wherein the ski length, for transport and the like, may be reduced to approximatey fifty percent of the normal ski length for the express purpose of ease of transport and storage.

2. DESCRIPTION OF THE PRIOR ART

It has long been a dream of many skiers to be able to have a ski which can be broken down into a shorter length than the ordinary ski. Some efforts have been made in this direction, but all have failed to achieve the necessary balance and rigidity at the break point. Therefore, there has been prior art in the general theory of breaking down the ski into two or more portions. There has been no successful achievement of an apparatus, properly, and easily, to break down and rejoin the portions of a ski.

SUMMARY OF THE INVENTION

Skiing, a rapidly growing sport, and frequently essential means of transportation in snow conditions and the like, utilizes a pair of lengthy skis for traveling across the snow areas, whether for necessary transport, or for recreation.

During actual use as skis, skis must be fairly lengthy, and are quite effective and are not clumsy.

However, when skis are transported, as is frequently necessary, either by the person using, or to use the skis, they frequently become cumbersome, particularly when backpacking into remote areas, or when being transported by aircraft or vehicle. Additionally, they are frequently difficult in storage for the same reasons.

Ski poles present a somewhat similar problem, although not quite so aggravated in overall length for transport. In this respect, sometime ago I gave thought and development to these problems, and my first effort produced the collapsible ski pole described in my co-pending patent application Ser. No. 592,127, filed June 30, 1975, now abandoned.

I then devoted considerable study and development to the problem of the ski itself.

There are many problems associated with attempting to break down a ski into more than one part, since the overall ski must perform under very severe stress and strain conditions and with much flexing and the like depending upon the conditions.

The details of the requirements will be described below in the description of a preferred embodiment, but any skiier knows the necessity of proper balance, proper flex, and the like in the skis. Up until now, it has generally been thought that it was not possible to make a multi-part ski, which can be broken down for transport, which can be easily and quickly assembled or disassembled in the field, and which had the necessary balance rigidity, flex and twist characteristics, and the like.

I have accomplished the end desired by dividing the two portions of the ski at a highly critical point closely adjacent to the binding, and by a dual interlocking system between the portions, together with especially designed overlapping sole plate to provide a continuous smooth running surface.

Further, I have utilized an adjustable, quick disconnect, cam like action fastener upon the side of the skis where it interferes with no part of the skiing activity and does not destroy the weight or balance of the ski.

It is an object of this invention to provide a ski composed of two parts, which can be assembled in the field into a properly performing ski by any skier.

Another object of this invention is to provide a collapsible ski which maintains all of the desired running characteristics and strength of a unitary ski.

Another object of this invention is to provide such a ski as described wherein the breakdown and holding elements do not interfere with normal skiing.

Another object of the invention is to provide a ski as described wherein any skier can assemble or disassemble the components without effort under skiing conditions.

The foregoing and other objects and advantages will become apparent to those skilled in the art upon reading the description of a preferred embodiment which follows, in conjunction with a study of the appended drawings.

DESCRIPTION OF A PREFERRED EMBODIMENT

Figure 1:
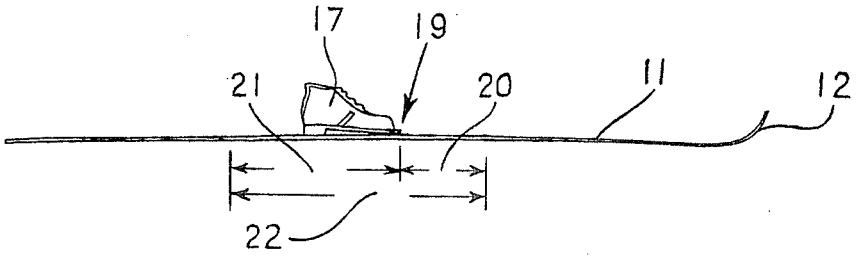
FIG. 1 is a side elevational view of a ski showing a ski boot in position, and illustrating certain critical proportions involved in the ski and the breakdown position.

FIG. 1 is designed solely to illustrate, what is well known to those skilled in the skiing art, and that is an important relationship for skis of all types, and this important relationship runs to an area directly beneath and immediately adjacent to the boot and binding area.

As shown in FIG. 1, this critical area for a ski 11 having a normal tip 12 commences with a position 19, which is always a line very close to the tip of the boot at the binding area. There is an overall distance 22 involved, and this is divided proportionally into distance 21 and 20 on each side of the line 19. To give a specific example, it is well accepted that for high performance cross country type, or nordic, skiing, the overall area beneath the boot which requires critical waxing and the like, the distance 22 will be approximately two feet to two and one-half feet in overall length. The critical amount on each side of the balance line 19 will be one-third to the front at 20 and two-thirds to the rear at 21.

The critical balance point 19, has created problems, in the past, for those seeking to divide a ski into a properly collapsible pair of elements.

Figure 2:
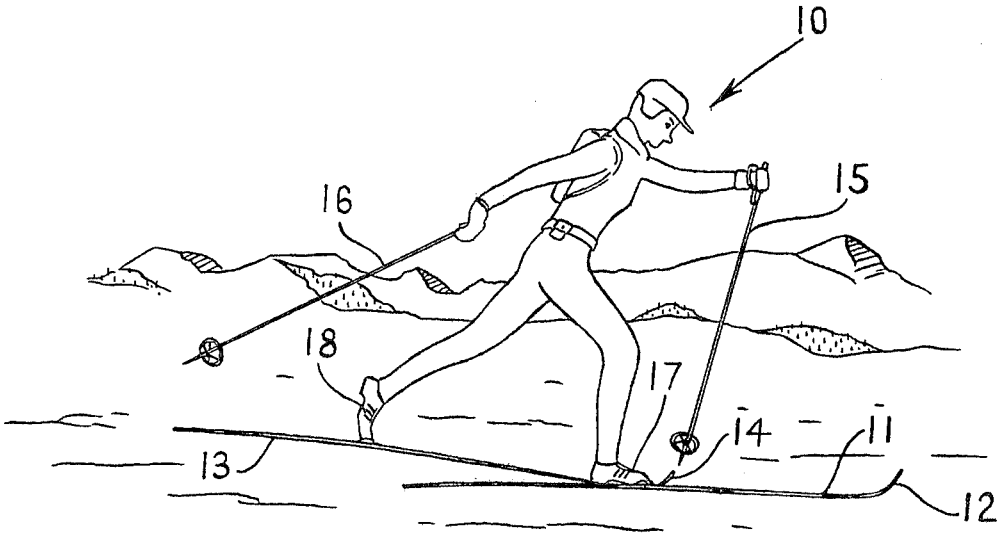
FIG. 2 illustrates a skier utilizing a pair of skis of the type shown by one ski in FIG. 1.

FIG. 2 illustrates the situation of the ski and what happens to it during normal skiing. It will be observed that the ski 13 fastened to the boot 18 worn by the skier 10, as lifted, may have its tip 14 slightly touching the surface, but it will be arched approximately to its maximum right beneath the toe of the boot 18. The ski pole 16 at this point is being brought forward through the air, and the ski pole 15 is being used for balance while the weight of the skier through boot 17 is on ski 11.

Figure 3:
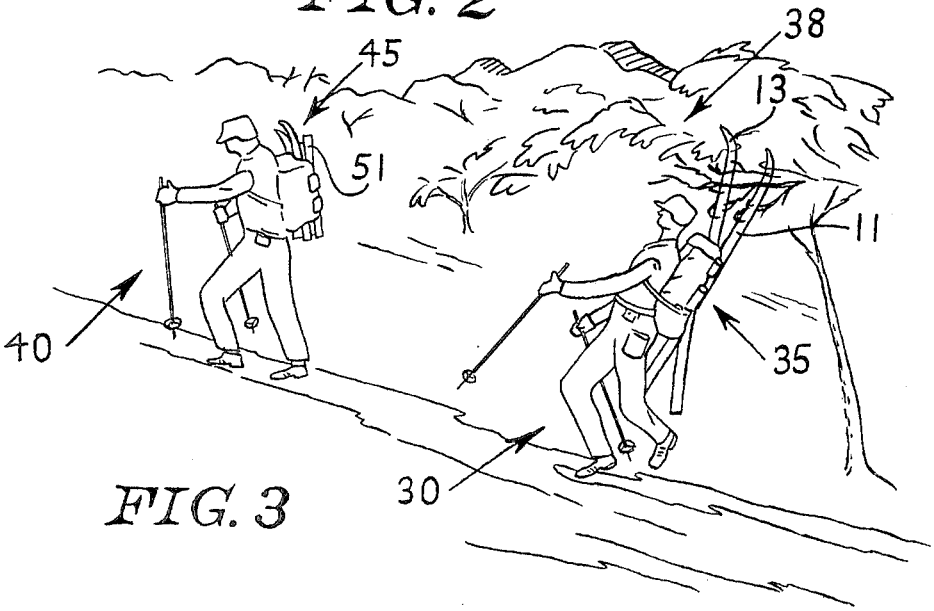
FIG. 3 illustrates the situation involved where skiers are backpacking into a ski area and particularly shows the reasons and advantages of the present invention over customary skis.

FIG. 3 shows the condition of a pair of skiers backpacking into a wilderness area for skiing. Each of the skiers 30 and 40 carries a backpack generally 35 and 45 containing the necessary provisions, and utilizing the backpack for the additional transport of their skis 11 and 13 in the case of skier 30 and 51 and 52 in the case of skier 40. Skier 40 is utilizing skis of this invention, and thus is able to move forward rapidly without being concerned about generally overhanging tree limbs and the like. It will be observed, and skiers who have participated in these activities will recognize, the problems normally encountered by a skier such as skier 30 wherein the skis 11 and 13 are constantly being caught by low hanging branches of trees and the like. This makes travel most difficult.

Figure 4:
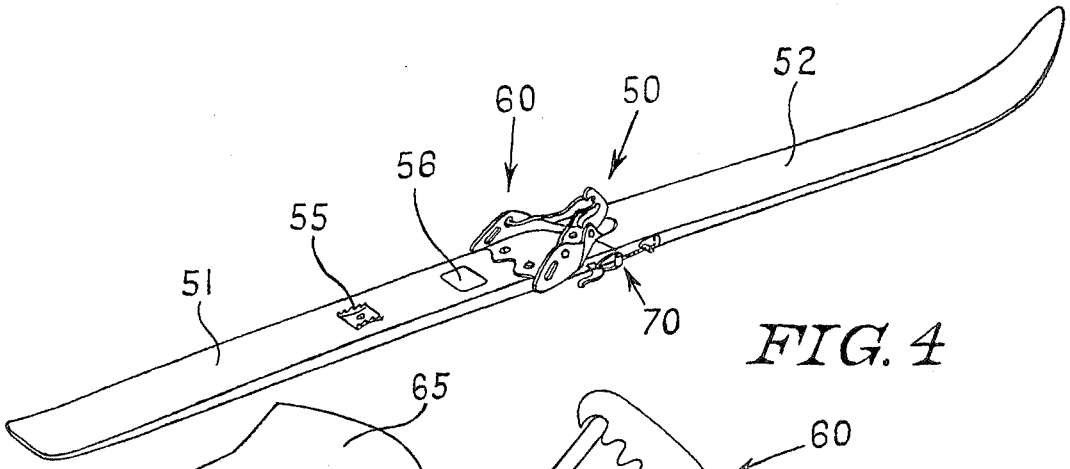
FIG. 4 is a perspective of a ski of this invention.

Turning now to FIG. 4, we begin to study the structure of the particular collapsible ski arrangement I have developed. A ski, generally 50, is shown consisting of the front portion 52 and the rear portion 51, with customary bindings 60 (for cross country type skiing) and boot plate 56 with heel plate 52. The breakdown side fastening mechanism, generally 70, is shown on one side of the ski in FIG. 4.

Figure 5:
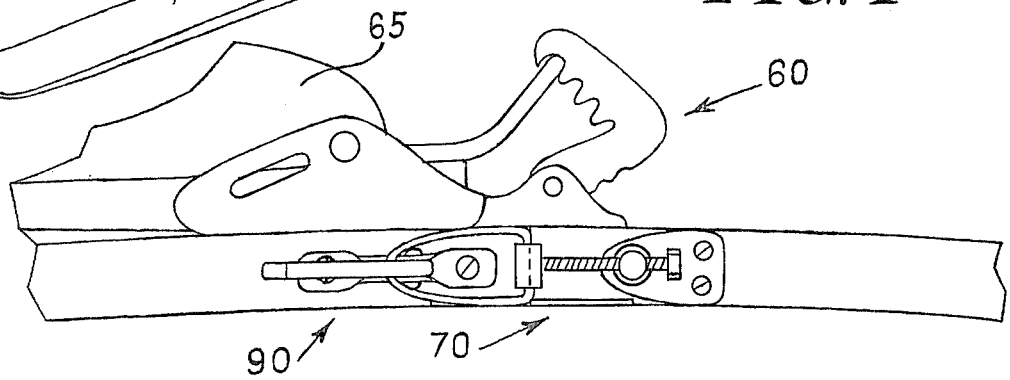
FIG. 5 is a side elevation, enlarged, of the portion of the ski wherein the breakdown occurs in the ski of this invention and as otherwise shown in FIG. 4.

FIG. 5 shows in larger proportion the mechanism of FIG. 4, but a ski boot 65 has been placed in position, and the binding 60 has been placed in position to hold the ski boot 65, as is well known and customary in the art and will be understood by those skilled in this art. The area generally 90 is the area of the connecting sole plate and the side holding mechanism 70 is generally illustrated.

Figure 6:
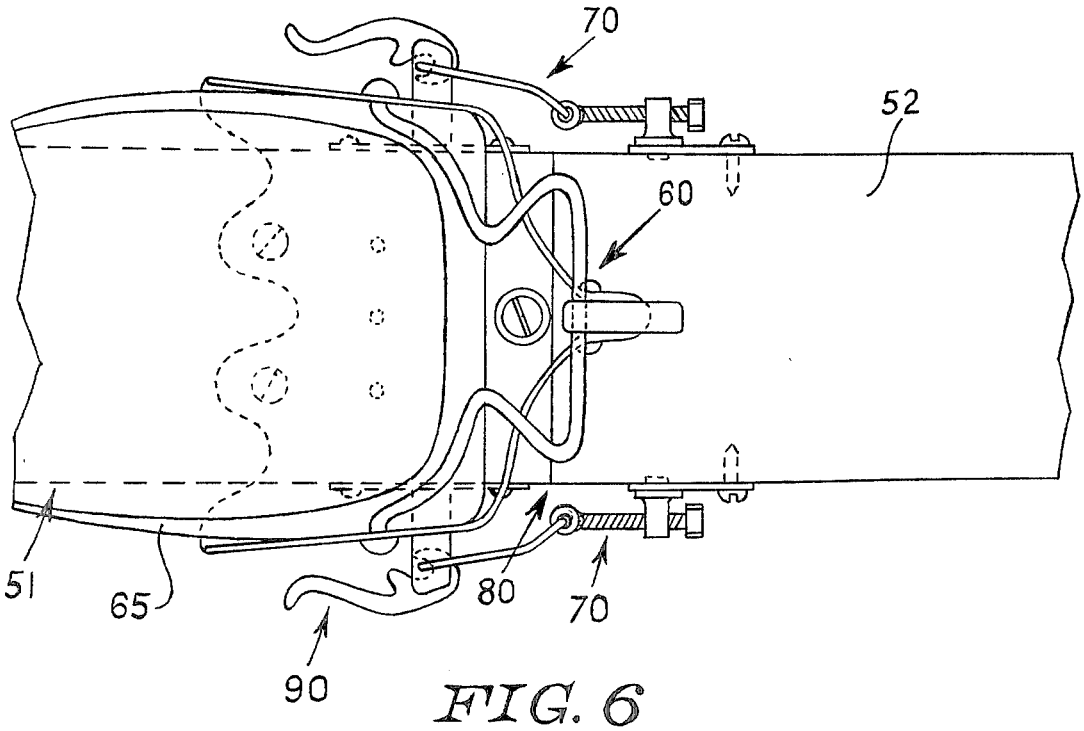
FIG. 6 is an enlarged partial top elevation of the ski mechanism of FIG. 4.

FIG. 6 is a view from the top of FIG. 5 once again showing the boot 65 with the configuration of the binding beneath the boot shown in fantom, and the binding portions above the boot appropriately shown wherein the boot is held in position by the customary means.

The side fastening elements 70 are shown on both sides of the ski, and these of course pull together, under tension, thus putting a firm compressive strength into the connection between elements 51 and 52 of the ski. The line 80 illustrates the joinder line of the two portions of the ski at the correct balance point as heretofore described.

Figures 7, 8, 9:
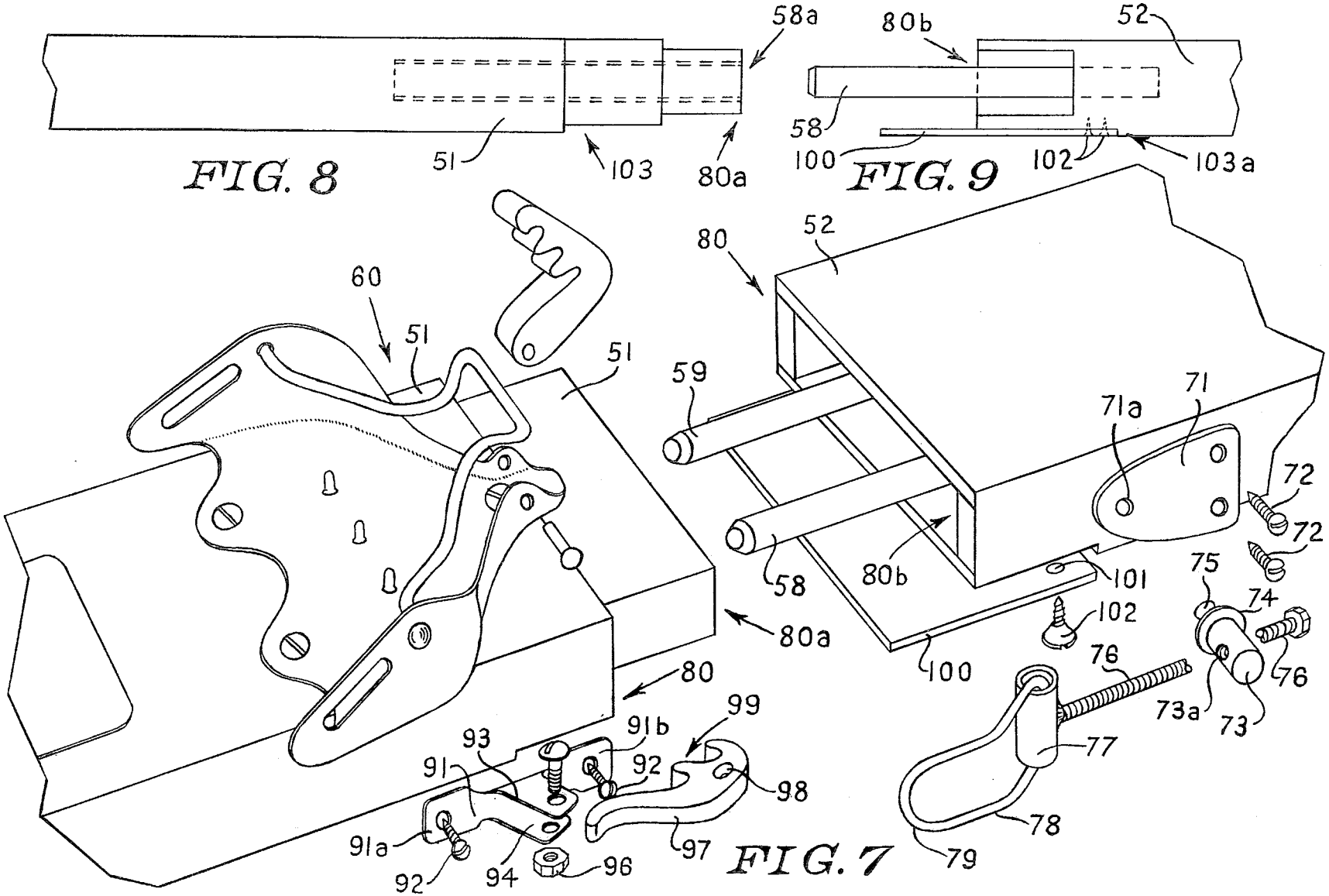
FIG. 7 is an exploded view of the elements in the ski breakdown.
FIG. 8 is a side elevation of one portion of the joining elements of the skis.
FIG. 9 is a side elevation of the other portion of the matching and assembling elements of the two ski portions.

FIG. 7 shows, in detail, the elements necessary in making the particular embodiment of this invention shown.

Certain of the elements of the binding 60 have been shown in exploded view, but these are only so shown since the overall view is so shown and for consistency. The important elements illustrated here are appropriately referenced with individual reference numerals. The ski 51 has a rectangularly shaped boss 80A depending outwardly from the breakpoint 80 as illustrated. This boss fits within socket 80B depending inwardly from breakpoint 80 in ski portion 52. A pair of dowels 58 and 59 depend from the interior of the socket 80B and are connected to the ski 52. These dowels fit within holes 58A appropriately located within the boss 80A as illustrated in FIG. 8.

Each side of the skis is provided with the mechanism generally, 70 heretofore described, and only one of which is shown in the particular view, since the two will be identical although reversed of course in location one on each side. A plate 71 is fastened to the side of ski element 52 by appropriate screws or the like 72. A boss 73 having a threaded portion 75 which will be inserted in the hole 71A of plate 71 is provided. Flange 74 provides the stop position for the boss 73 when fastened within 71. It will be understood by the fastening with threads in this manner the boss may be backed off to a position perpendicular to the plane of the ski for turning and adjusting the buckle. Additionally by making the threads loose or by a loose rivet connection or the like sufficient play would be provided.

HOle 73A provided through boss 73 is threaded so as to accommodate threaded rod 76. By the means of the thread, the length and distance by which the fastening elements 77–78–79 will protrude, and thus the tension, may be adjusted.

The other portion of the clamping arrangement is shown in detail associated with ski portion 51, to which it is attached in use.

The other portion on portion 51 of the ski consists of a plate 91 having a configuration basically as shown with a tab 91A at one end and a tab 91B at the other end suitably provided with holes to accommodate screws or the like 92 to be held upon the ski. A pair of tabs 93 and 94 are provided at ninety degree relationships to the basic element 91 and a pair of holes are provided bolt or the like 95 which is inserted through hole 98 in cam arrangement 97. This is held in position when assembled by the nut or the like 96. Cam arrangement 97 is seen to have a number of holding teeth 99 which will accommodate and match with portion 79 of the clamp arrangement part attached to ski element 52.

The operation of this type of clamping arrangement is well known to those skilled in the art, and particularly is adaptable for fast connecting and disconnecting, and through the threaded arrangement heretofore described at 76–73A, is totally adjustable for necessary tension.

The side elevations FIG. 8 and FIG. 9 show the socket 80B in portion 52 of the ski together with the dowels 58 and the boss 80A which enters the socket 80B, together with the holes 58A to accommodate the dowels 58. A slightly notched out portion at 103 is illustrated on FIG. 51, which is so arranged as to accommodate plate 100 fastened into a similar notch arrangement 103A in portion 52. The sale plate 100 is fastened by screws 102 into forward portion 52 of the ski, and need not be fastened to the rear portion.

While the embodiment of this invention, specifically shown and described, is fully capable of achieving the objects and advantages desired, it is to be understood that this embodiment has been shown for purposes of illustration only, and not for purposes of limitation.

I claim:

1. A collapsible ski comprising: a first ski portion having connecting means including a protruding element suitable to engage in the second ski portion, and containing within said protruding element two sockets suitable to engage two protruding bosses; a second ski portion having connecting means cooperative with the connecting means on the first ski portion wherein the said connecting means comprises a socket suitable to engage the protruding element on the first ski portion and wherein two protruding bosses protrude outwardly from the base of the socket in the second ski portion in such manner that the protruding bosses may engage within the two sockets within the protruding elements on the first ski portion; releasable means holding the two ski portions in connecting relationships with one another; and, sole plate means covering the connection between the two ski portions on their underside.

2. The apparatus of claim 1 wherein the said socket means on the second ski portion is provided within the protrusion means on the second ski portion.

3. The apparatus of claim 3, wherein the connecting means constitute two releasable cam connecting means, one of which is mounted between the two ski portions on one side, and the other of which is mounted between the two ski portions on the other side.

4. A two piece ski comprising in combination: (1) A first ski element comprising an elongated ski portion, including on its first end the front running tip of a ski, and on its second end a socket having a pair of parallel cylindrical members attached to the base of said socket and extending outwardly from said base through said socket to the exterior thereof, and having a cut away portion on the running side of the ski beneath the said socket; (2) A second ski element having the running tail end of the ski upon one end, and a protrusion upon the other end of size and shape to cooperate with and engage with and enter into the socket upon said first ski element, and in which said protrusion has two cylindrical sockets adapted to the two cylindrical elements protruding from the said socket on the first ski element, and wherein the underside of said second ski element adjacent said socket has a cut away portion to match the cut away portion on the underside of the first said ski element; (3) A sole plate suitable to fit within the cut away portions under the two ski elements when they are joined together; (4) Means to fasten said sole plate to one of said ski elements; (5) One part of a two part adjustable cam fastening device fastened to one side of the first ski element adjacent the socket area; (6) The other part of the said two part fastening device fastened to the second ski element adjacent the protrusion thereon in such manner as to cooperate with the said first part of said fastener to hold the two ski portions in firm contact when they are joined together; and (7) A similiar fastening device fastened to the opposite sides of said ski elements.

* * * * *